US012250967B2

(12) United States Patent
Xu et al.

(10) Patent No.: US 12,250,967 B2
(45) Date of Patent: Mar. 18, 2025

(54) ELECTRONIC CIGARETTE BODY, VAPORIZATION DEVICE, AND ELECTRONIC CIGARETTE

(71) Applicant: SHENZHEN RELX TECHNOLOGY CO., LTD., Shenzhen (CN)

(72) Inventors: Shengyang Xu, Shenzhen (CN); Ruofeng Li, Shenzhen (CN); Jiaqi Fu, Shenzhen (CN)

(73) Assignee: SHENZHEN RELX TECHNOLOGY CO., LTD., ShenZhen (CN)

( * ) Notice: Subject to any disclaimer, the term of this patent is extended or adjusted under 35 U.S.C. 154(b) by 528 days.

(21) Appl. No.: 17/606,110

(22) PCT Filed: May 27, 2021

(86) PCT No.: PCT/CN2021/096347
§ 371 (c)(1),
(2) Date: Oct. 25, 2021

(87) PCT Pub. No.: WO2022/057307
PCT Pub. Date: Mar. 24, 2022

(65) Prior Publication Data

US 2022/0225666 A1 Jul. 21, 2022

(30) Foreign Application Priority Data

Sep. 21, 2020 (CN) ..... 202022087361.8

(51) Int. Cl.
*A24F 40/10* (2020.01)
*A24F 40/40* (2020.01)
(Continued)

(52) U.S. Cl.
CPC ..... *A24F 40/10* (2020.01); *A24F 40/40* (2020.01); *A24F 40/46* (2020.01); *A24F 40/485* (2020.01);
(Continued)

(58) Field of Classification Search
CPC ..... A24F 40/10; A24F 40/40; A24F 40/46; A24F 40/485; A24F 40/51; A24F 40/90;
(Continued)

(56) References Cited

U.S. PATENT DOCUMENTS

2017/0071251 A1* 3/2017 Goch ..... A24F 40/485

FOREIGN PATENT DOCUMENTS

CN 205671480 U 11/2016
CN 106231937 A 12/2016
(Continued)

OTHER PUBLICATIONS

PCT International Search Report mailed Aug. 2, 2021 in counterpart PCT application PCT/CN2021/096347, 6 pages in Chinese.
(Continued)

*Primary Examiner* — Justin M Kratt
(74) *Attorney, Agent, or Firm* — ScienBiziP, P.C.

(57) ABSTRACT

An electronic cigarette body, a vaporization device, and an electronic cigarette are provided. The electronic cigarette body includes a housing provided with a power supply. One end of the housing is configured to be connected to the vaporization device, and an airflow channel is provided in the housing. A heating portion and a heated portion in an airflow communication with the heating portion are provided in the airflow channel. One end of the vaporization device is provided with a mouthpiece and the other end of the vaporization device is configured to be connected to the electronic cigarette body. The electronic cigarette includes the electronic cigarette body and the vaporization device. The electronic cigarette body, the vaporization device, and the electronic cigarette provided in this application may enrich flavors of the vapor vaped by a user and improve the user's experience.

11 Claims, 11 Drawing Sheets

(51) Int. Cl.

| | |
|---|---|
| ***A24F 40/46*** | (2020.01) |
| ***A24F 40/485*** | (2020.01) |
| ***A24F 40/51*** | (2020.01) |
| ***A24F 40/90*** | (2020.01) |
| *A24F 40/20* | (2020.01) |
| *A24F 40/30* | (2020.01) |
| *A24F 40/42* | (2020.01) |
| *A24F 40/48* | (2020.01) |
| *A24F 40/50* | (2020.01) |
| *A24F 40/57* | (2020.01) |

(52) U.S. Cl.
CPC ..... *A24F 40/51* (2020.01); *A24F 40/90* (2020.01); *A24F 40/20* (2020.01); *A24F 40/30* (2020.01); *A24F 40/42* (2020.01); *A24F 40/48* (2020.01); *A24F 40/50* (2020.01); *A24F 40/57* (2020.01)

(58) Field of Classification Search
CPC ..... A24F 40/20; A24F 40/30; A24F 40/42; A24F 40/48; A24F 40/50; A24F 40/57
See application file for complete search history.

(56) References Cited

FOREIGN PATENT DOCUMENTS

| | | | | | |
|---|---|---|---|---|---|
| CN | 111317176 | A | | 6/2020 | |
| EP | 3692832 | A1 | | 8/2020 | |
| GB | 2535809 | A | * | 8/2016 | ..... A24F 40/46 |
| WO | 2016024083 | A1 | | 2/2016 | |

OTHER PUBLICATIONS

PCT Written Opinion mailed Aug. 2, 2021 in counterpart PCT application PCT/CN2021/096347, 4 pages in Chinese.

* cited by examiner

ELECTRONIC CIGARETTE BODY, VAPORIZATION DEVICE, AND ELECTRONIC CIGARETTE

CROSS-REFERENCE TO RELATED APPLICATION

This application is a national stage application filed under 35 U.S.C. 371 of International Application No. PCT/CN2021/096347 filed May 27, 2021, which claims priority to China Patent Application No. 202022087361.8 filed Sep. 21, 2020. The entire disclosures of the above applications are incorporated herein by reference in their entirety.

TECHNICAL FIELD

This application relates to an electronic device, and specifically to an electronic cigarette body, a vaporization device, and an electronic cigarette.

BACKGROUND

In recent years, manufacturers start to produce a wide range of electronic cigarette products, including an e-liquid type electronic cigarette product that heats and atomizes a volatile solution to produce a vapor for a user to vape. E-liquid generally includes different flavors of fragrances, which can be atomized to produce different fragrances.

SUMMARY

This application provides an electronic cigarette body, a vaporization device, and an electronic cigarette to provide aroma of the electronic cigarette in a way that is different from the related art.

This application provides an electronic cigarette body. The electronic cigarette body includes a housing provided with a power supply. One end of the housing is configured to be connected to a vaporization device, and an airflow channel is provided in the housing. A heating portion and a heated portion in an airflow communication with the heating portion are provided in the airflow channel.

In an implementation, the heated portion is located at downstream of the heating portion in an airflow direction.

In an implementation, the electronic cigarette body further includes a temperature sensor, configured to measure a temperature of the heating portion.

In an implementation, the housing has a first part and a second part located at the one end, the second part being located between the first part and the one end; and the first part is configured to dispose the heating portion and the heated portion, and the second part is configured to be connected to the vaporization device.

In an implementation, a hollow base is provided in the first part, a hollow part of the hollow base including a heating region and a heated region, respectively configured to dispose the heating portion and the heated portion.

In an implementation, the heating region and the heated region are arranged in a direction toward the one end.

In an implementation, an electric connection terminal is further provided in the first part, the electric connection terminal being disposed between the base and an inner wall of the housing.

This application further provides a vaporization device. One end of the vaporization device is provided with a mouthpiece and the other end of the vaporization device is configured to be connected to the electronic cigarette body.

In an implementation, an end portion of the other end of the vaporization device is provided with a concave portion. The concave portion, used as a heated portion, is configured to be in communication with the heated portion of the electronic cigarette body and accommodate part of a flavor adjusting portion.

In an implementation, the concave portion is located at a central region of the end portion.

This application further provides an electronic cigarette. The electronic cigarette includes the aforementioned electronic cigarette body and vaporization device.

In an implementation, the concave portion of the vaporization device is aligned with the heated portion of the electronic cigarette body in a depth direction of the concave portion.

The electronic cigarette body, the vaporization device, and the electronic cigarette provided in this application may enrich flavors of the vapor vaped by a user and improve the user's experience.

BRIEF DESCRIPTION OF THE DRAWINGS

The accompanying drawings are provided for further understanding of this application and constitute part of the specification, and explain this application together with the following specific implementations, but do not constitute a limitation to this application. In the accompanying drawings.

DETAILED DESCRIPTION

Figure 1:
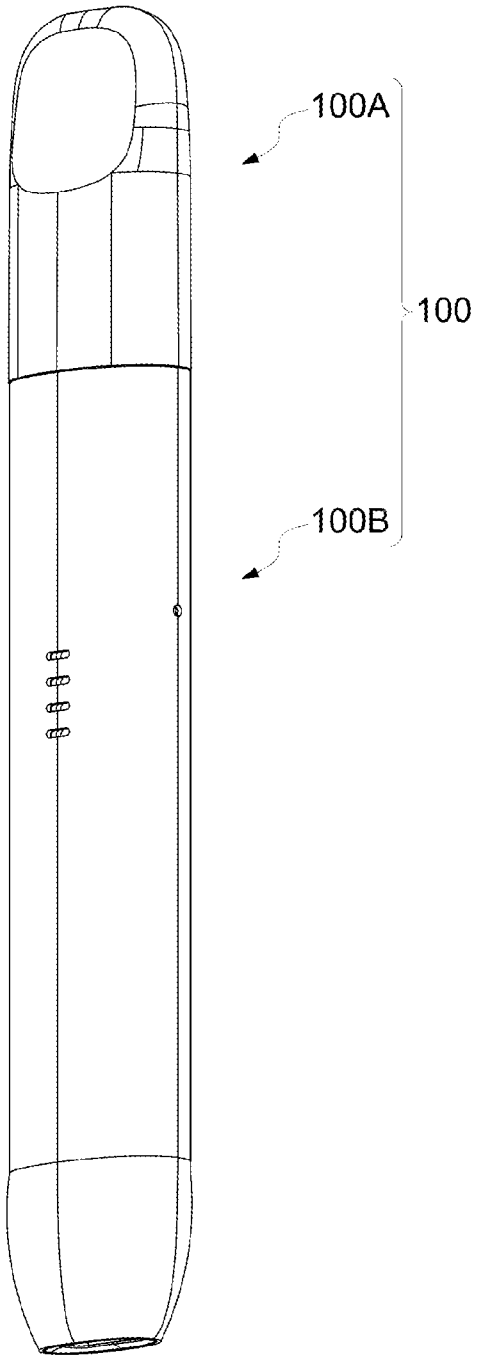
FIG. 1 is a schematic diagram of an electronic cigarette according to some embodiments of this application.

The following disclosure provides many different embodiments or examples for implementing different features of the provided subject matter. The following describes particular examples of members and deployments. Certainly, these are merely examples and are not intended to be limitative. In this application, in the following descriptions, reference formed by the first feature above or on the second feature may include an embodiment formed by direct contact between the first feature and the second feature, and may further include an embodiment in which an additional feature may be formed between the first feature and the second feature to enable the first feature and the second feature to be not in direct contact. In addition, in this application, reference numerals and/or letters may be repeated in examples. This repetition is for the purpose of simplification and clarity, and does not indicate a relationship between the described various embodiments and/or configurations.

The embodiments of this application are described in detail below. However, it should be understood that, this application provides many applicable concepts that can be implemented in various particular cases. The described particular embodiments are only illustrative and do not limit the scope of this application.

FIG. 1 is a schematic diagram of an electronic cigarette 100 according to some embodiments of this application.

The electronic cigarette 100 includes a vaporization device 100A and an electronic cigarette body 100B. In some embodiments, the vaporization device 100A and the electronic cigarette body 100B may be designed as a unity. In some embodiments, the vaporization device 100A and the electronic cigarette body 100B may be designed as two separate members. In some embodiments, the vaporization device 100A may be designed to be removably combined with the electronic cigarette body 100B. In some embodiments, when the vaporization device 100A is combined with the electronic cigarette body 100B, the vaporization device 100A is partly accommodated in the electronic cigarette body 100B. In some embodiments, the vaporization device 100A may be referred to as a cartridge or an e-liquid storage assembly. The vaporization device 100A stores an atomization material. The atomization material may be a liquid. The atomization material may be a solution. The atomization material may alternatively be referred to as e-liquid. The e-liquid is edible. In some embodiments, the electronic cigarette body 100B may be referred to as a main body.

Figure 2:
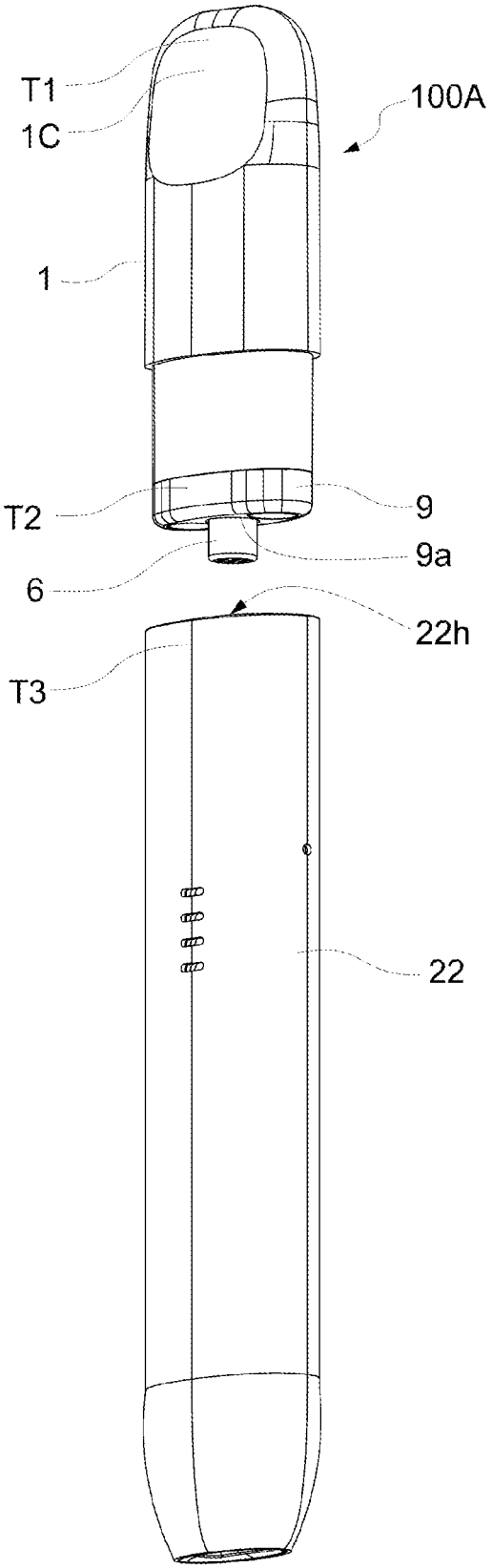
FIG. 2 is a schematic diagram of a demonstrative combination of an electronic cigarette according to some embodiments of this application.

FIG. 2 is a schematic diagram of a demonstrative combination of an electronic cigarette 100 according to some embodiments of this application.

From the appearance, the vaporization device 100A includes a casing 1 and a base 9. The casing 1 is provided with a mouthpiece 1*c* which is generally flat circular. The mouthpiece 1*c* is located at an end portion T1 of the vaporization device 100A. In other embodiments, the mouthpiece 1*c* may be in other shapes.

The base 9 is located at an end portion T2 of the vaporization device 100A relative to the end portion T1. The base 9 includes a concave portion 9*a* used for accommodating a flavor adjusting portion 6 (may also referring to FIG. 3C). The concave portion 9*a* is in communication with an atomization chamber inside the vaporization device 100A. The concave portion 9*a* is used as an air-inlet vent, and air flows into the vaporization device 100A through the concave portion 9*a*. In some embodiments, the concave portion 9*a* is disposed at a central region of the base 9. In some embodiments, the concave portion 9*a* is disposed on the central axis of the vaporization device 100A, and in other words, the concave portion 9*a* may be located at the center position of the base 9. The flavor adjusting portion 6 stores an atomization material. In some embodiments, the vaporization device 100A may not have directivity. In some embodiments, the vaporization device 100A may be removably combined with the electronic cigarette body 100B in either of two different directions (for example, a direction in which the mouthpiece 1*c* shown in FIG. 2 faces upward or a direction in which the mouthpiece 1*c* faces downward).

The electronic cigarette body 100B has a housing 22. The housing 22 has an end portion T3. The end portion T3 is connected to the vaporization device 100A. The end portion T3 includes an opening 22*h*. When the vaporization device 100A is combined with the electronic cigarette body 100B, the opening 22*h* accommodates the end portion T2 of the vaporization device 100A. As a heated portion, the concave portion 9*a* receives heat from the electronic cigarette body 100B and heats the flavor adjusting portion 6 at the same time. When the flavor adjusting portion 6 is heated, the stored atomization material is heated and atomized, and the atomized gas flows into the vaporization device 100A to provide more different flavors. A detailed structure of the vaporization device 100A is described in subsequent embodiments.

FIG. 3A, FIG. 3B, FIG. 3C, and FIG. 3D are schematic exploded views of a vaporization device 100A according to some embodiments of this application.

As shown in FIG. 3A, FIG. 3B, FIG. 3C, and FIG. 3D, in addition to the casing 1, the flavor adjusting portion 6, and the base 9, the vaporization device 100A further includes an upper cover sealing member 2, an upper cover 3, a sealing member 4, a vapor generation assembly 5, a support 61, a middle cover 71, and a sealing ring 8.

Figure 3A:
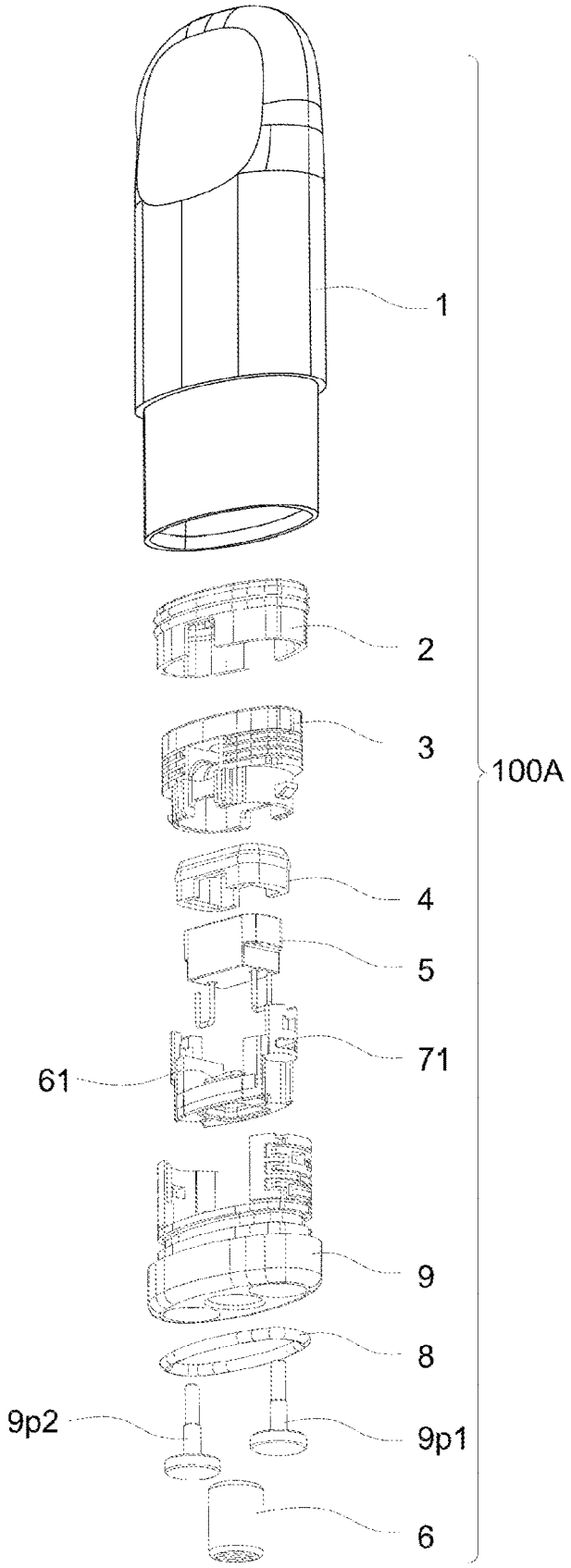
FIG. 3A, FIG. 3B, FIG. 3C, and FIG. 3D are schematic exploded views of a vaporization device according to some embodiments of this application.
Figure 3B:
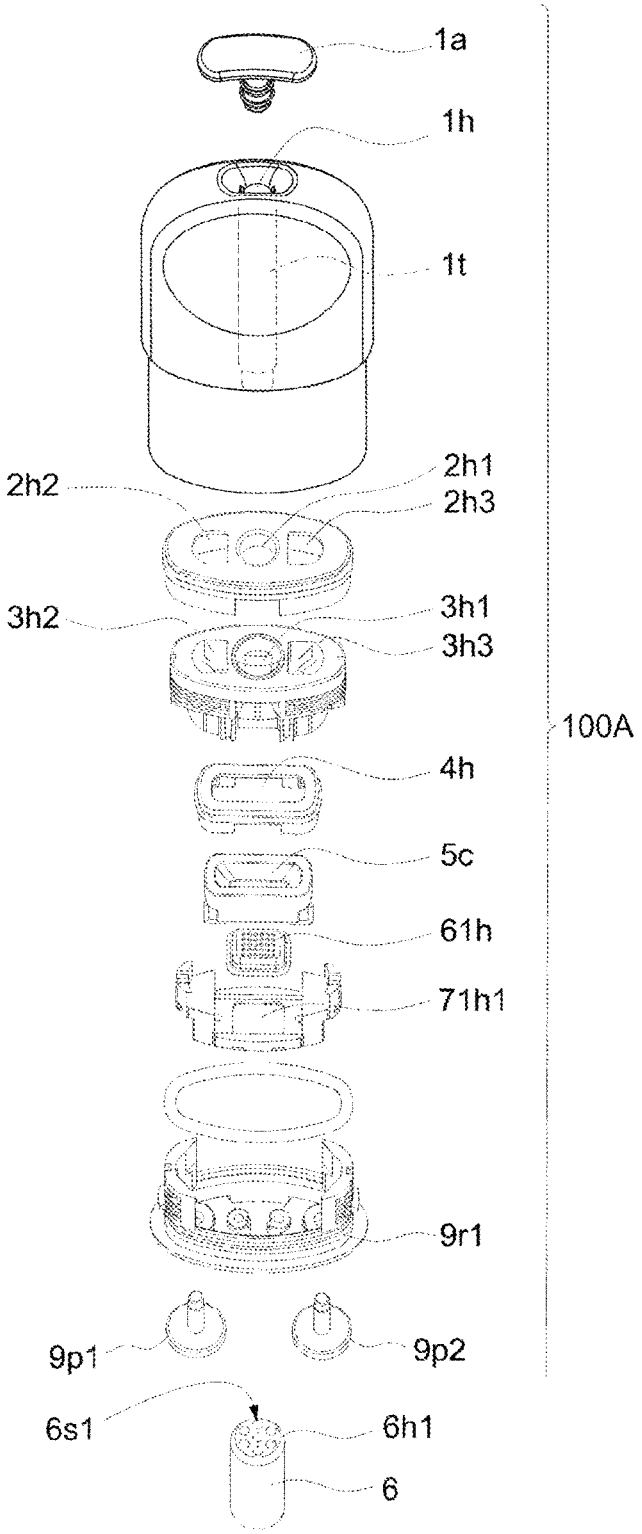
Figure 3C:
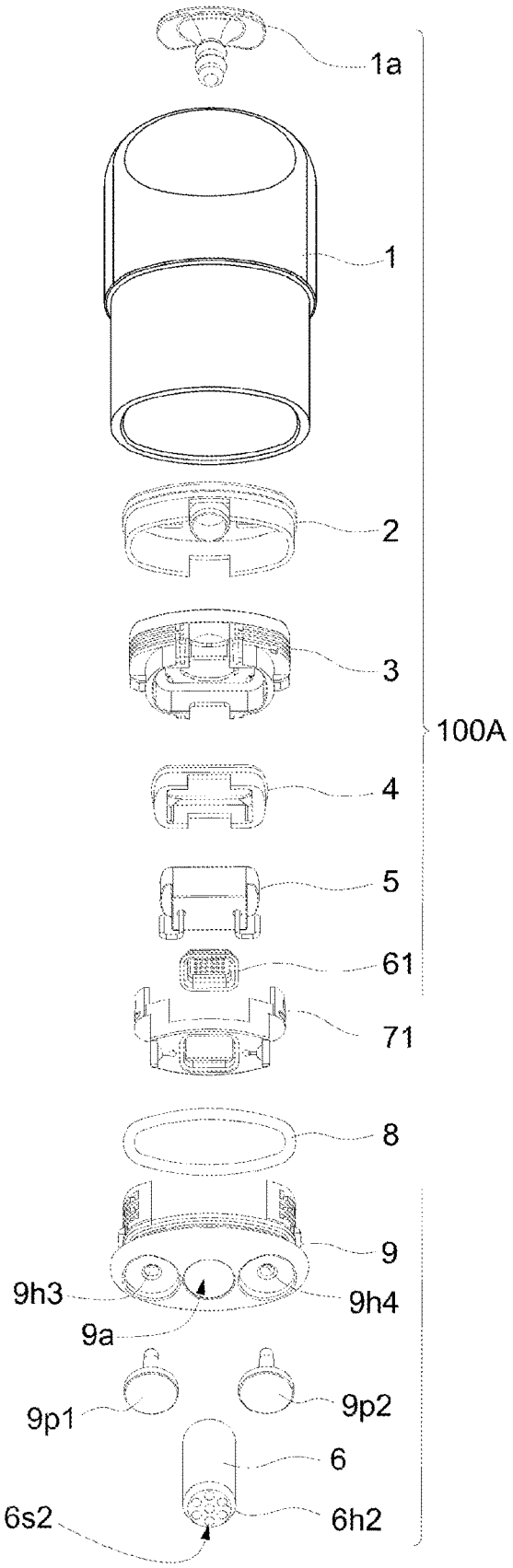

Referring to FIG. 3B, a tube 1*t* is provided in the casing 1. The tube 1*t* is in communication with an opening 1*h*. When the vaporization device 100A is in use, vapor generated by the vaporization device 100A may be vaped by the user through the tube 1*t*.

As shown in FIG. 3B, the upper cover sealing member 2 may be provided with a plurality of openings. The upper cover 3 may be provided with a plurality of openings. In some embodiments, the upper cover sealing member 2 may be provided with a first opening 2*h*1, a second opening 2*h*2, and a third opening 2*h*3. In some embodiments, the upper cover 3 may be provided with a first opening 3*h*1, a second opening 3*h*2, and a third opening 3*h*3. The first opening 2*h*1, the second opening 2*h*2, and the third opening 2*h*3 of the upper cover sealing member 2 are respectively corresponding to the first opening 3*h*1, the second opening 3*h*2, and the third opening 3*h*3 of the upper cover 3. The first opening 2*h*1, the second opening 2*h*2, and the third opening 2*h*3 of the upper cover sealing member 2 respectively expose the first opening 3*h*1, the second opening 3*h*2, and the third opening 3*h*3 of the upper cover 3.

The first opening 3*h*1 of the upper cover 3 may be used as part of a vapor channel. The vapor generated by the vapor generation assembly 5 may reach the tube 1*t* inside the casing 1 through the first opening 3*h*1 of the upper cover 3. The second opening 3*h*2 and the third opening 3*h*3 of the upper cover 3 may be used as part of an e-liquid channel. E-liquid stored in the vaporization device 100A may flow to the vapor generation assembly 5 through the openings 3*h*2 and 3*h*3. The E-liquid stored in the vaporization device 100A may be in contact with the vapor generation assembly 5 through the second opening 3*h*2 and the third opening 3*h*3 of the upper cover 3. The first opening 3*h*1 and the second opening 3*h*2 of the upper cover 3 are isolated from each other, and e-liquid flowing in the second opening 3*h*2 does not flow into the vapor channel directly. The first opening 3*h*1 and the third opening 3*h*3 of the upper cover 3 are isolated from each other, and e-liquid flowing in the third opening 3*h*3 of the upper cover 3 does not flow into the vapor channel directly.

In some embodiments, a quantity of the openings of the upper cover sealing member 2 may be the same as that of the upper cover 3. In some embodiments, a quantity of the openings of the upper cover sealing member 2 may be different from that of the upper cover 3. In some embodiments, a quantity of the openings of the upper cover sealing member 2 may be less than that of the upper cover 3. In some embodiments, a quantity of the openings of the upper cover sealing member 2 may be greater than that of the upper cover 3.

When some or all the members of the vaporization device 100A are combined with each other, the upper cover sealing member 2 may cover part of the upper cover 3. The upper cover sealing member 2 may surround part of the upper cover 3. The upper cover sealing member 2 may expose part of the upper cover 3.

In some embodiments, the upper cover sealing member 2 may have elasticity. In some embodiments, the upper cover sealing member 2 may have flexibility. In some embodiments, the upper cover sealing member 2 may include silica gel. In some embodiments, the upper cover sealing member 2 may be made of silica gel.

When some or all the members of the vaporization device 100A are combined with each other, the sealing member 4 may cover part of the vapor generation assembly 5. The sealing member 4 may surround part of the vapor generation assembly 5. The sealing member 4 may expose part of the vapor generation assembly 5.

In some embodiments, the sealing member 4 may have elasticity. In some embodiments, the sealing member 4 may have flexibility. In some embodiments, the sealing member 4 may include silica gel. In some embodiments, the sealing member 4 may be made of silica gel. The sealing member 4 may have high temperature resistance. In some embodiments, the sealing member 4 has a melting point higher than 350 degrees Celsius.

As shown in FIG. 3B, the sealing member 4 has an opening 4*h*, and the vapor generation assembly 5 has a recess 5*c*. When the sealing member 4 and the vapor generation assembly 5 are combined with each other, the opening 4*h* of the sealing member 4 may expose at least part of the recess 5*c*.

Figure 3D:
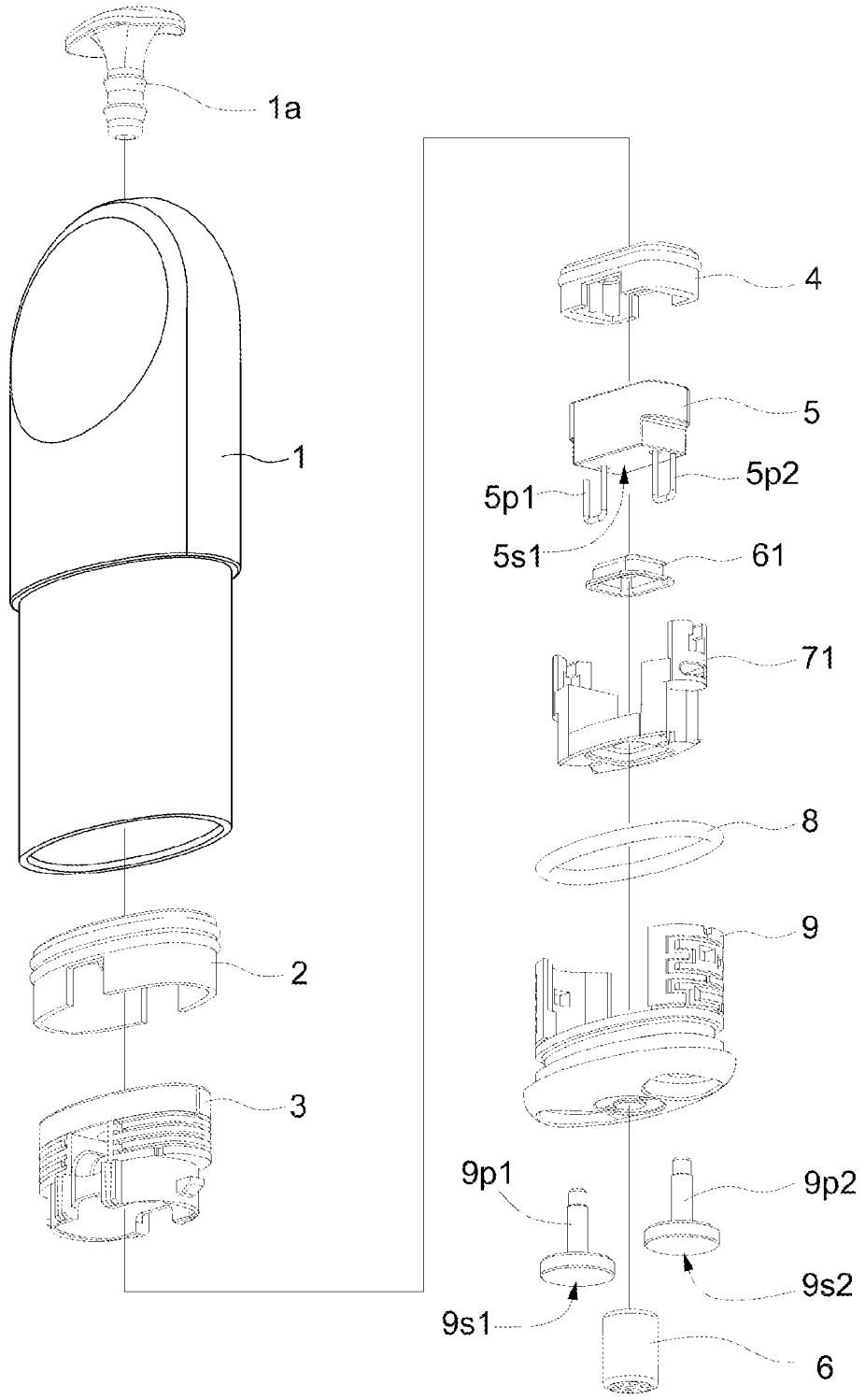

As shown in FIG. 3D, the vapor generation assembly 5 includes a first electrically conductive pin 5*p*1 and a second electrically conductive pin 5*p*2. The first electrically conductive pin 5*p*1 and the second electrically conductive pin 5*p*2 are hooks curved towards two sides. Shapes of the first electrically conductive pin 5*p*1 and the second electrically conductive pin 5*p*2 have many advantages. During assembly of the vaporization device 100A, the shapes of the first electrically conductive pin 5*p*1 and the second electrically conductive pin 5*p*2 are designed to enable the first electrically conductive pin 5*p*1 and the second electrically conductive pin 5*p*2 to be easily in contact with a first electrically conductive structure 9*p*1 and a second electrically conductive structure 9*p*2. The shape design of the first electrically conductive pin 5*p*1 and the second electrically conductive pin 5*p*2 decreases a probability of poor contact between the first electrically conductive pin 5*p*1 and the second electrically conductive pin 5*p*2 and the first electrically conductive structure 9*p*1 and the second electrically conductive structure 9*p*2. The shape design of the first electrically conductive pin 5*p*1 and the second electrically conductive pin 5*p*2 further reduces steps for assembling the vaporization device 100A.

Although not drawn in FIG. 3D, the vapor generation assembly 5 may include a heating circuit disposed on a bottom surface 5*s*1. The heating circuit disposed on the bottom surface 5*s*1 is electrically connected to the first electrically conductive pin 5*p*1 and the second electrically conductive pin 5*p*2. The vaporization device 100 may increase the temperature of the vapor generation assembly 5 by providing power to the heating circuit on the bottom surface 5*s*1.

The support 61 may have a rectangular shape. The support 61 has a plurality of openings 61*h*. In some embodiments, the plurality of openings 61*h* are arranged on the support 61 in a matrix. In some embodiments, the support 61 may have a circular shape. In some embodiments, the support 61 may have a triangular shape. In some embodiments, the support 61 may have a polygonal shape.

In some embodiments, the plurality of openings 61*h* of the support 61 are arranged at the same distance. The openings 61*h* of the support 61 may have the same aperture. In some embodiments, the openings 61*h* of the support 61 may have different apertures. In some embodiments, the opening 61*h* of the support 61 may have an aperture of 0.1 mm. In some embodiments, the opening 61*h* of the support 61 may have an aperture of 0.2 mm. In some embodiments, the opening 61*h* of the support 61 may have an aperture of 0.3 mm. In some embodiments, the opening 61*h* of the support 61 may have an aperture of 0.35 mm. In some embodiments, the opening 61*h* of the support 61 may have an aperture of 0.4 mm. In some embodiments, the opening 61*h* of the support 61 may have an aperture of 0.5 mm.

In some embodiments, the aperture of the opening 61*h* of the support 61 may be within a range of 0.1 mm to 0.2 mm. In some embodiments, the aperture of the opening 61*h* of the support 61 may be within a range of 0.2 mm to 0.3 mm. In some embodiments, the aperture of the opening 61*h* of the support 61 may be within a range of 0.15 mm to 0.35 mm. In some embodiments, the aperture of the opening 61*h* of the support 61 may be within a range of 0.3 mm to 0.4 mm. In some embodiments, the aperture of the opening 61*h* of the support 61 may be within a range of 0.4 mm to 0.5 mm.

The support 61 may include a plastic material. The support 61 may be made of a plastic material. The support 61 may include a metallic material. The support 61 may be made of a metallic material. In some embodiments, the support 61 may include stainless steel.

The middle cover 71 may include an opening 71*h*1. The support 61 may be disposed on the middle cover 71. The support 61 may be disposed above the opening 71*h*1 in the middle cover 71. The support 61 may cover the opening 71*h*1 of the middle cover 71. The length of the opening 71*h*1 of the middle cover 71 is approximately slightly less than the length of the support 61. The width of the opening 71*h*1 of the middle cover 71 is approximately slightly less than the width of the support 61. Therefore, after the support 61 is mounted in the opening 71*h*1 of the middle cover 71, there is no need to use an additional member for fixing the support 61 and the middle cover 71. When the support 61 is disposed on the middle cover 71, the openings 61*h* on the support 61 can enable an airflow to pass through.

The bottom of the base 9 includes a recess 9*r*1. The sealing ring 8 may be disposed inside the recess 9*r*1 at the bottom of the base 9. The base 9 includes openings 9*h*3 and 9*h*4 disposed at two sides of the concave portion 9*a*. The first electrically conductive structure 9*p*1 and the second electrically conductive structure 9*p*2 may respectively pass through the openings 9*h*3 and 9*h*4 of the base 9, and are secured on the base 9. The first electrically conductive structure 9*p*1 and the second electrically conductive structure 9*p*2 pass through the openings 9*h*3 and 9*h*4 of the base 9, and extend to an inner portion of the vaporization device 100A. The first electrically conductive structure 9*p*1 and the second electrically conductive structure 9*p*2 may have a current conduction function. The first electrically conductive structure 9*p*1 and the second electrically conductive structure 9*p*2 may provide power to the vapor generation assembly 5 inside the vaporization device 100A.

After the first electrically conductive structure 9*p*1 and the second electrically conductive structure 9*p*2 pass through the openings 9*h*3 and 9*h*4 of the base 9, an electric contact surface 9*s*1 of the first electrically conductive structure 9*p*1 and an electric contact surface 9*s*2 of the second electrically conductive structure 9p2 are exposed out of an outer surface of the base 9. The first electrically conductive structure 9p1 and the second electrically conductive structure 9p2 may include metal. The first electrically conductive structure 9p1 and the second electrically conductive structure 9p2 may be attracted by magnetic members.

As shown in FIG. 3A to FIG. 3D, in some embodiments, the vaporization device 100 may include a protection plug 1a. The protection plug 1a is detachably disposed, and extends into the opening 1h. In this case, the protection plug 1a may prevent foreign matters from entering the opening 1h. When the vaporization device 100A is not in use, the protection plug 1a may prevent an e-liquid or a condensed liquid from leaking from the opening 1h. When the vaporization device 100A has just been manufactured, the protection plug 1a may have a good sealing effect, to prevent e-liquid from leaking during transport in the vaporization device 100A.

Before starting to use the vaporization device 100A, the user need to first remove the protection plug 1a, and then use the vaporization device 100A.

The flavor adjusting portion 6 includes a top surface 6s1 and a bottom surface 6s2 disposed opposite to each other. The top surface 6s1 includes a plurality of openings 6h1. The bottom surface 6s2 includes a plurality of openings 6h2. In some embodiments, the quantity of the plurality of openings 6h1 corresponds to the quantity of the plurality of openings 6h2. In some embodiments, the plurality of openings 6h1 are in communication with the plurality of openings 6h2.

As shown in FIG. 2, when some or all of the vaporization device 100A are combined with each other, the top surface 6s1 of the flavor adjusting portion 6 is disposed in the concave portion 9a of the base 9, and the bottom surface 6s2 of the flavor adjusting portion 6 is exposed out of the base 9. When some or all of the vaporization device 100A are combined with each other, the plurality of openings 6h2 replace the concave portion 9a to be used as an air inlet vent, and air flows into the vaporization device 100A through the plurality of openings 6h2.

It is to be noted that, structures of the vaporization device 100A shown in FIG. 3A to FIG. 3D are only examples and descriptions, and this application does not limit components to be included in the vaporization device 100A, and also does not limit shapes of the components in the vaporization device 100A.

FIG. 4A, FIG. 4B, FIG. 4C, and FIG. 4D respectively are a section side view, a partial enlarged side view, a section front view, and a partial enlarged front view of an electronic cigarette body 100B according to some embodiments of this application.

The housing 22 of the electronic cigarette body 100B includes a first part T3p1 and a second part T3p2 located at the end portion T3. The second part T3p2 is located between the first part T3p1 and the end portion T3. The second part T3p2 is configured to accommodate the end portion T2 of the vaporization device 100A and to be connected to the vaporization device 100A.

Figure 4A:
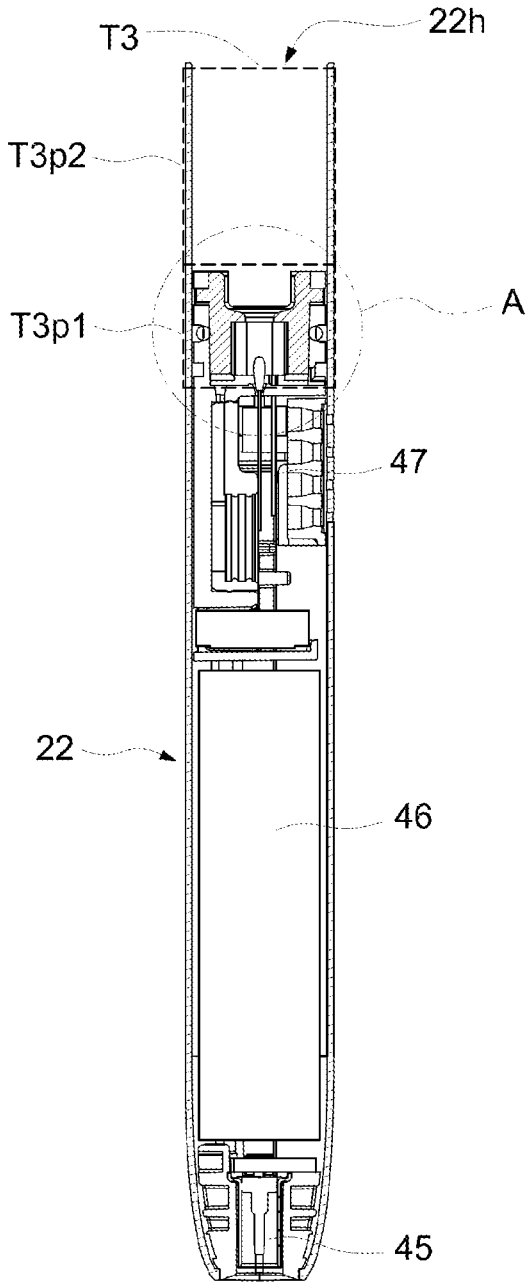
FIG. 4A, FIG. 4B, FIG. 4C, and FIG. 4D respectively are a section side view, a partial enlarged side view, a section front view, and a partial enlarged front view of an electronic cigarette body according to some embodiments of this application.
Figure 4B:
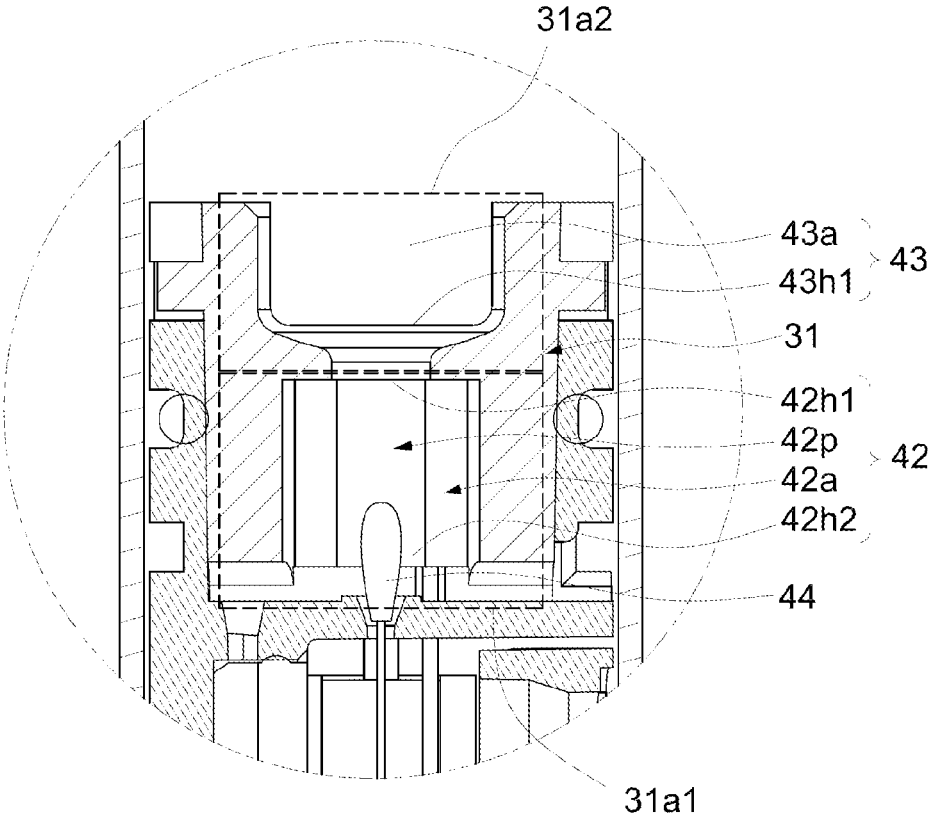
Figure 4C:
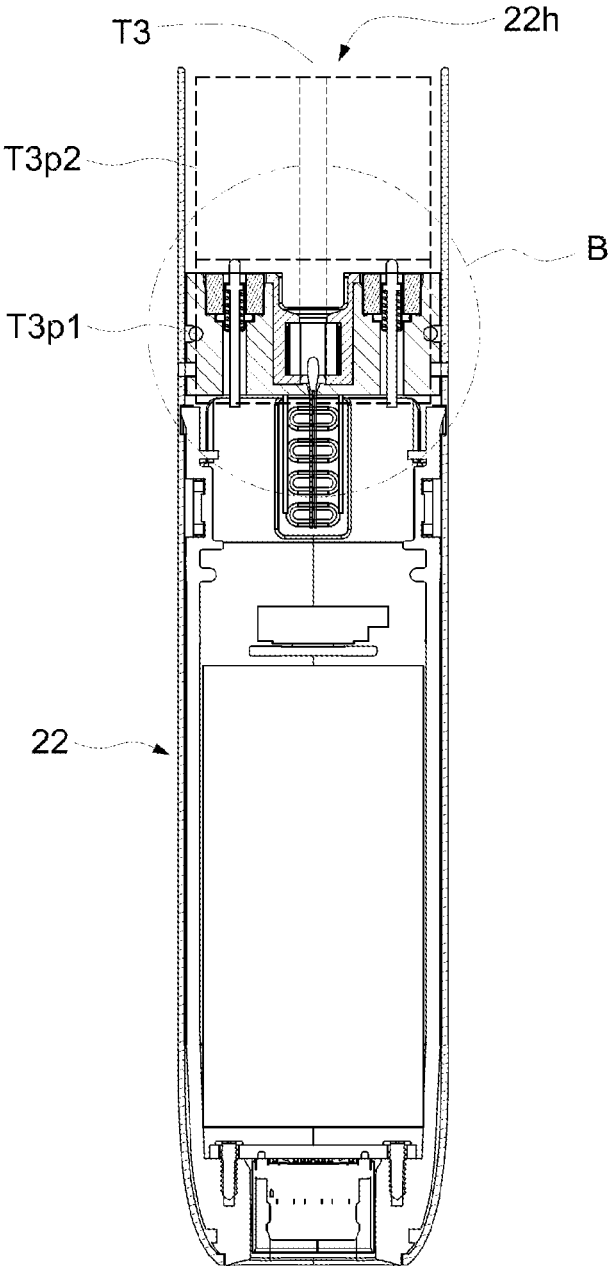

As shown in a partial enlarged view in FIG. 4B, the first part T3p1 includes a base 31. The base 31 includes a hollow structure. The hollow structure of the base 31 may be generally divided into a heating region 31a1 and a heated region 31a2. In some embodiments, the heating region 31a1 and the heated region 31a2 are arranged in a direction toward the end portion T3.

A heating portion 42 is provided in the heating region 31a1. The heating portion 42 includes a hollow portion 42p and a heat source portion 42a for air to pass through. The heat source portion 42a is configured to heat air in the hollow portion 42p. In some embodiments, the hollow portion 42p is a through hole running through the heating portion 42. The hollow portion 42p forms a first opening 42h1 on an upper surface of the heating portion 42. The hollow portion 42p forms a second opening 42h2 on a lower surface of the heating portion 42. The heat source portion 42a is provided with a heating circuit used for converting electrical energy into heat. In some embodiments, the heating portion 42 is generally a column, and the heat source portion 42a is disposed at a periphery of the column and around the hollow portion 42p. However, a shape and a heating manner of the heating portion 42 is not limited in this application.

The heated region 31a2 is provided with a heated portion 43. The heated portion 43 includes a recess 43a. In some embodiments, the heated portion 43 is aligned with the concave portion 9a of the base 9 in a depth direction of the concave portion 9a. In this setting, when the vaporization device 100A is combined with the electronic cigarette body 100B, the recess 43a may accommodate part of the flavor adjusting portion 6 exposed out of the base 9. The heated portion 43 further includes an opening 43h1 located at a bottom of the heated portion 43. In some embodiments, the opening 43h1 of the heated portion 43 is in communication with the first opening 42h1 of the heating portion 42.

Figure 4D:
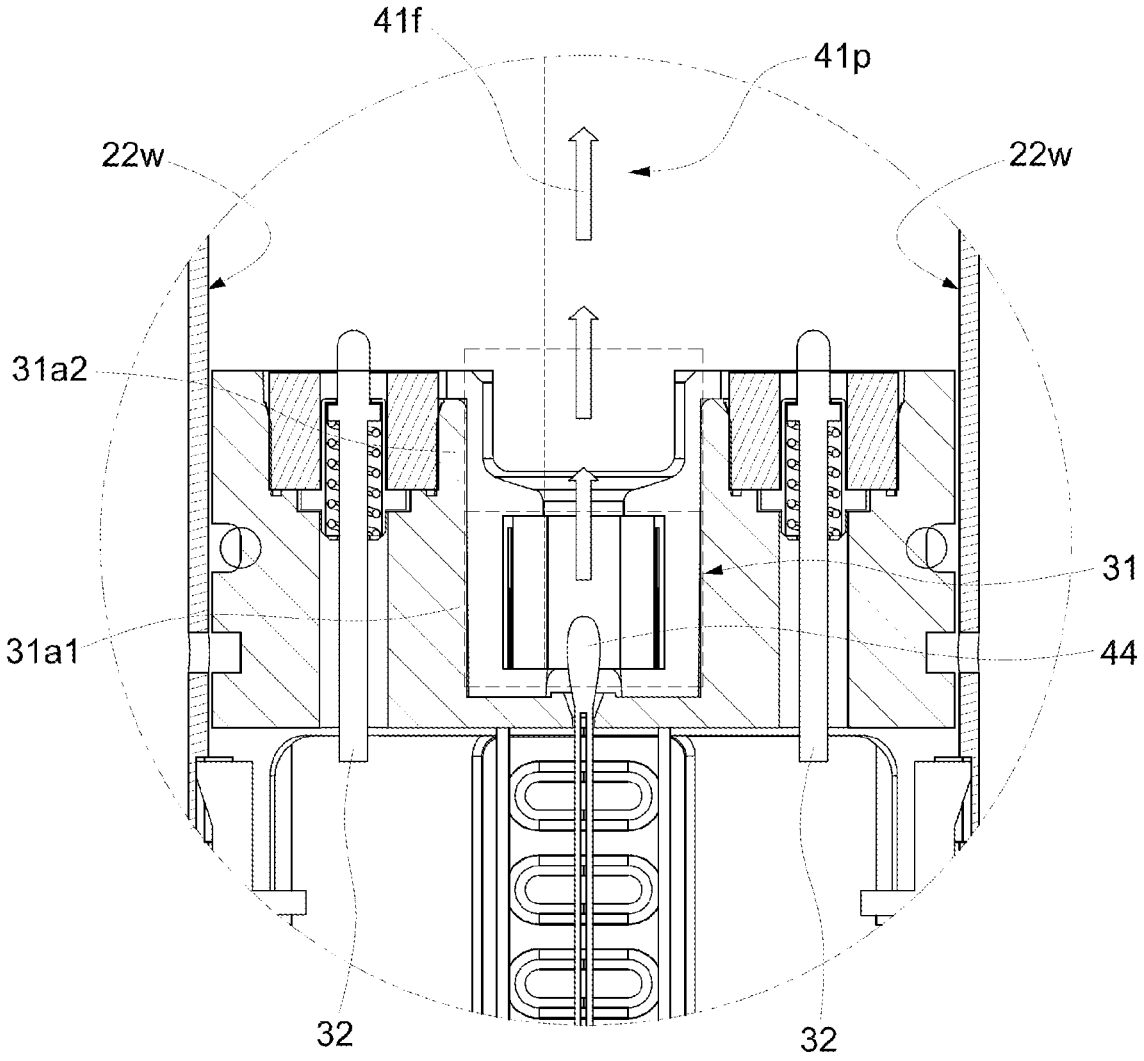

Referring to FIG. 4D, an airflow channel 41p (identified in a dotted line in FIG. 4D) is provided in the housing 22. In some embodiments, a width range of the airflow channel 41p is limited in an inner wall 22w of the housing 22. In some embodiments, the airflow channel 41p covers the heating portion 42 of the heating region 31a1 and the heated portion 43 of the heated region 31a2. In some embodiments, the width of the airflow channel 41p is roughly equal to the width of the hollow portion 42p. In some embodiments, the airflow channel 41p extends in a vertical direction, which is corresponding to an extension direction of the heating region 31a1 and the heated region 31a2. In some embodiments, corresponding to the airflow channel 41p extending in a vertical direction, an airflow direction is shown by an arrow 41f. In this setting, along the airflow direction 41f, the heated portion 43 in the heated region 31a2 is located at downstream of the heating region 31a1.

However, this application does not limit thereto. In other embodiments, the heating region 31a1 and the heated region 31a2 may not be arranged in the direction toward the end portion T3. For example, the heating region 31a1 and the heated region 31a2 may be arranged horizontally, or staggered in a vertical direction. Correspondingly, the airflow channel 41p and the airflow direction 41f may not extend in a vertical direction.

Referring to FIG. 4D, the first part T3p1 further includes an electric connection terminal 32. In some embodiments, there are two electric connection terminals 32. In some embodiments, two electric connection terminals 32 are disposed between the base 31 and the inner wall 22w. When the vaporization device 100A is combined with the electronic cigarette body 100B, upper ends of the two electric connection terminals 32 are in contact with the first electrically conductive structure 9p1 and the second electrically conductive structure 9p2 respectively, to conduct electric power to the vapor generation assembly 5 by using the first electrically conductive structure 9p1 and the second electrically conductive structure 9p2. In some embodiments, the electric connection terminals 32 may be combined with magnetic members. When the vaporization device 100A is combined with the electronic cigarette body 100B, magnetic attraction force between the magnetic member and the first electrically conductive structure 9*p*1 and between the magnetic member and the second electrically conductive structure 9*p*2 may prevent the vaporization device 100A from loosing. In some embodiments, the electric connection terminals 32 include spring probes or other forms of probes to conduct electric power to the vaporization device 100A.

The electronic cigarette body 100B further includes a temperature sensor 44 configured to measure an air temperature. A top end of the temperature sensor 44 enters the hollow portion 42*p* through the opening 42*h*2. The electronic cigarette body 100B further includes a charging member 45, a battery 46, and a main circuit board 47. The charging member 45 includes a charging circuit board. When the charging member 45 is connected to an external charging cable to which a power supply is connected, the battery 46 is charged. As a power supply, the battery 46 is configured to supply electric power to electrical elements that require electricity in the electronic cigarette 100. The main circuit board 47 is configured to control components of the electronic cigarette 100 to collaborate to implement functions of the electronic cigarette 100. A person skilled in the art should understand that the electronic cigarette body 100B may further include other elements to implement the functions of the electronic cigarette 100, and only the part related to the invention spirit of this application is described in detail herein for concise.

Figure 5:
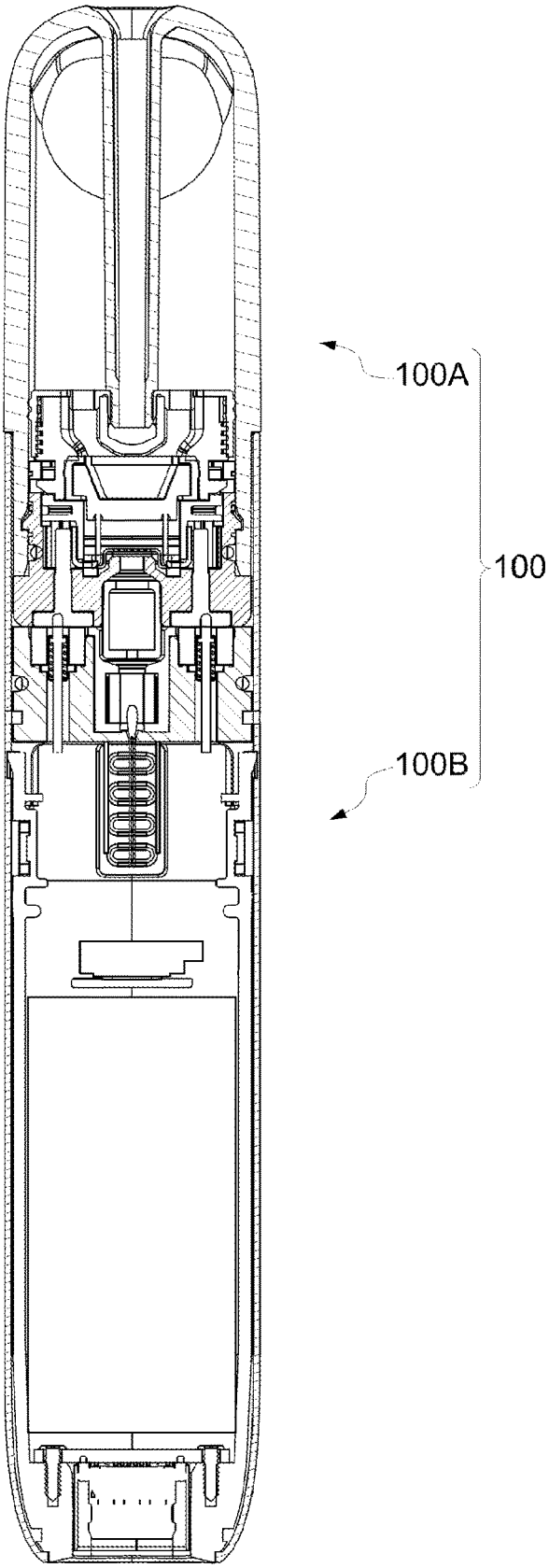
FIG. 5 is a structural section view of an electronic cigarette according to some embodiments of this application.

Referring to FIG. 5 and FIG. 4A to FIG. 4D at the same time, FIG. 5 is a structural section view of an electronic cigarette 100 according to some embodiments of this application. When a user uses the electronic cigarette 100, the suction pulls air in the electronic cigarette body 100B to flow along the airflow channel 41*p*. After flowing into the hollow portion 42*p* from below the heating portion 42 through the opening 42*h*2, the air is heated by heat power provided by the heat source portion 42*a*, and flows into the heated portion 43 through the opening 42*h*1 and the opening 43*h*1. In some embodiments, the heated air is about 40-60° C. Moisture in the heated air may be reduced to improve generation of condensate between the vaporization device 100A and the electronic cigarette body 100B and to dry generated condensate, to prevent the condensate from damaging electronic parts and components. The recess 43*a* of the heated portion 43 accommodates part of a flavor adjusting portion 6, to enable the heated air to flow into the flavor adjusting portion 6 to prompt volatilization of flavor adjusting materials in the flavor adjusting portion 6. Air entrained with atomized gas flows into the atomization chamber of the vaporization device 100A. In this case, the concentration and aroma of the atomized gas to be vaped by the user may be increased.

As used herein, the terms "approximately", "basically", "substantially", and "about" are used to describe and consider small variations. When used in combination with an event or a situation, the terms may refer to an example in which an event or a situation occurs accurately and an example in which the event or situation occurs approximately. As used herein with respect to a given value or range, the term "about" generally means in the range of ±10%, ±5%, ±1%, or ±0.5% of the given value or range. The range may be indicated herein as from one endpoint to another endpoint or between two endpoints. Unless otherwise specified, all ranges disclosed herein include endpoints. The term "substantially coplanar" may refer to two surfaces within a few micrometers (μm) positioned along the same plane, for example, within 10 within within 1 or within 0.5 μm positioned along the same plane. When reference is made to "substantially" the same numerical value or characteristic, the term may refer to a value within ±10%, ±5%, ±1%, or ±0.5% of the average of the values.

As used herein, the terms "approximately", "basically", "substantially", and "about" are used to describe and explain small variations. When used in combination with an event or a situation, the terms may refer to an example in which an event or a situation occurs accurately and an example in which the event or situation occurs approximately. For example, when being used in combination with a value, the term may refer to a variation range of less than or equal to ±10% of the value, for example, less than or equal to ±5%, less than or equal to ±4%, less than or equal to ±3%, less than or equal to ±2%, less than or equal to ±1%, less than or equal to ±0.5%, less than or equal to ±0.1%, or less than or equal to ±0.05%. For example, if a difference between two values is less than or equal to ±10% of an average value of the value (for example, less than or equal to ±5%, less than or equal to ±4%, less than or equal to ±3%, less than or equal to ±2%, less than or equal to ±1%, less than or equal to ±0.5%, less than or equal to ±0.1%, or less than or equal to ±0.05%), it could be considered that the two values are "substantially" or "approximately" the same. For example, being "substantially" parallel may refer to an angular variation range of less than or equal to ±10° with respect to 0°, for example, less than or equal to ±5°, less than or equal to ±4°, less than or equal to ±3°, less than or equal to ±2°, less than or equal to ±1°, less than or equal to ±0.5°, less than or equal to ±0.1°, or less than or equal to ±0.05°. For example, being "substantially" perpendicular may refer to an angular variation range of less than or equal to ±10° with respect to 90°, for example, less than or equal to ±5°, less than or equal to ±4°, less than or equal to ±3°, less than or equal to ±2°, less than or equal to ±1°, less than or equal to ±0.5°, less than or equal to ±0.1°, or less than or equal to ±0.05°.

For example, two surfaces can be deemed to be coplanar or substantially coplanar if a displacement between the two surfaces is no greater than 5 μm no greater than 2 μm no greater than 1 or no greater than 0.5 μm. A surface can be deemed to be planar or substantially planar if a displacement between any two points on the surface with respect to a plane is no greater than 5 μm no greater than 2 μm no greater than 1 μm or no greater than 0.5 μm.

As used herein, the terms "conductive", "electrically conductive" and "electrical conductivity" refer to an ability to transport an electric current. Electrically conductive materials typically indicate those materials that exhibit little or no opposition to the flow of an electric current. One measure of electrical conductivity is Siemens per meter (S/m). Typically, an electrically conductive material is one having a conductivity greater than approximately 104 S/m, such as at least 105 S/m or at least 106 S/m. The electrical conductivity of a material can sometimes vary with temperature. Unless otherwise specified, the electrical conductivity of a material is measured at room temperature.

As used herein, singular terms "a", "an", and "the" may include plural referents unless the context clearly dictates otherwise. In the description of some embodiments, assemblies provided "on" or "above" another assembly may encompass a case in which a previous assembly is directly on a latter assembly (for example, in physical contact with the latter assembly), and a case in which one or more intermediate assemblies are located between the previous assembly and the latter assembly.

As used herein, for ease of description, space-related terms such as "under", "below", "lower portion", "above", "upper portion", "lower portion", "left side", "right side", and the like may be used herein to describe a relationship between one member or feature and another member or feature as shown in the figures. In addition to orientation shown in the figures, space-related terms are intended to encompass different orientations of the device in use or operation. A device may be oriented in other ways (rotated 90 degrees or at other orientations), and the space-related descriptors used herein may also be used for explanation accordingly. It should be understood that when a member is "connected" or "coupled" to another member, the member may be directly connected to or coupled to another member, or an intermediate member may exist. Several embodiments of this disclosure and features of details are briefly described above. The embodiments described in this disclosure may be easily used as a basis for designing or modifying other processes and structures for realizing the same or similar objectives and/or obtaining the same or similar advantages introduced in the embodiments in the specification. Such equivalent construction does not depart from the spirit and scope of this disclosure, and various variations, replacements, and modifications can be made without departing from the spirit and scope of this disclosure.

What is claimed is:

1. An electronic cigarette, comprising:

an electronic cigarette body, and a vaporization device, wherein the electronic cigarette body comprises a housing in which a power supply is provided, one end of the housing being configured to be connected to the vaporization device, wherein an airflow channel is provided in the housing, a heating portion and a heated portion in an airflow communication with the heating portion being provided in the airflow channel; and wherein one end of the vaporization device is provided with a mouthpiece and the other end of the vaporization device is configured to be connected to the electronic cigarette body;

the vaporization device comprises a casing, a base, a flavor adjusting portion for storing an atomization material and a vapor generation assembly for generating vapor by heating e-liquid, one end of the casing is provided with the mouthpiece, the base is located at the other end of the casing, the vapor generation assembly is located inside the casing, the base comprises a concave portion, a part of flavor adjusting portion is received in the concave portion, the other part of the flavor adjusting portion protrudes to an outside of the base and the casing, the flavor adjusting portion comprises a plurality of openings penetrating the flavor adjusting portion, the plurality of openings is used as an air inlet vent through which air flows into the vaporization device, the other part of the flavor adjusting portion is received in the heated portion in the electronic cigarette body, the heating portion is used to heat air in the airflow channel and the heated air heated by the heating portion flows into the flavor adjusting portion in the heated portion to prompt volatilization of the atomization material in the flavor adjusting portion.

2. The electronic cigarette of claim 1, wherein the concave portion is aligned with the heated portion in a depth direction of the concave portion.

3. The electronic cigarette of claim 2, wherein the concave portion is configured to be in communication with the heated portion of the electronic cigarette body.

4. The electronic cigarette of claim 3, wherein the concave portion is located at a central region of the end portion.

5. The electronic cigarette of claim 1, wherein the heated portion is located downstream of the heating portion in an airflow direction.

6. The electronic cigarette of claim 1, further comprising a temperature sensor, configured to measure a temperature of the heating portion.

7. The electronic cigarette of claim 1, wherein the housing has a first part and a second part located at the one end, the second part being located between the first part and the one end; and the first part is configured to dispose the heating portion and the heated portion, and the second part is configured to be connected to the vaporization device.

8. The electronic cigarette of claim 7, wherein a hollow base is provided in the first part, and a hollow part of the hollow base comprises a heating region and a heated region, respectively configured to dispose the heating portion and the heated portion.

9. The electronic cigarette of claim 8, wherein the heating region and the heated region are arranged in a direction toward the one end.

10. The electronic cigarette of claim 9, wherein an electric connection terminal is further provided in the first part, and the electric connection terminal is disposed between the hollow base and an inner wall of the housing.

11. The electronic cigarette of claim 1, wherein the vapor generation assembly comprises a first electrically conductive pin and a second electrically conductive pin, the base further comprises a first opening and a second opening which are disposed at two sides of the concave portion, the vaporization device further comprises a first electrically conductive structure and a second electrically conductive structure, the first electrically conductive structure and the second electrically conductive structure respectively pass through the first opening and the second opening to be in contact with the first electrically conductive pin and the second electrically conductive pin so as to provide power to the vapor generation assembly.

* * * * *